US005226845A

United States Patent [19]

Wu

[11] Patent Number: 5,226,845

[45] Date of Patent: Jul. 13, 1993

[54] MUSIC BOX

[76] Inventor: Chih C. Wu, No. 10, Alley 13, Ping-Ho Rd., Chung-Ho City, Taiwan

[21] Appl. No.: 943,921

[22] Filed: Sep. 11, 1992

[51] Int. Cl.[5] ..... A63H 13/02; G09F 19/08

[52] U.S. Cl. ..... 446/265; 446/303; 446/357; 446/358; 40/414

[58] Field of Search ..... 446/297, 298, 303, 302, 446/352, 357, 358, 359, 366, 265, 236; 40/414, 411, 418, 456, 473, 415; 472/6, 29, 35

[56] References Cited

U.S. PATENT DOCUMENTS 2,840,949 7/1958 Faulkner ..... 446/265
4,573,939 3/1986 Hoshino ..... 446/303 X

FOREIGN PATENT DOCUMENTS 352221 3/1961 Switzerland ..... 446/303
5890 4/1896 United Kingdom ..... 446/297

*Primary Examiner*—Mickey Yu

*Attorney, Agent, or Firm*—Notaro & Michalos

[57] ABSTRACT

A music box having a hollow base within which a power supply and a driving mechanism are installed. A platform is rotatably mounted on the base to be driven by the driving mechanism on which a music playing doll and a dancing doll are movably and rotatably mounted. Each of the dolls has a driving rod secured thereon and the driving rods are guided by an activity generation plate which is disposed under the platform and driven by the driving mechanism to move and rotate the dolls. The activity generation plate has a circumferential groove in a wavy form in a plane parallel with the activity generation plate to receive therein an offset extension of one of the driving rods so as to move the extension portion in a radial direction and thus rotate the driving rod forth and back as the activity generation plate rotates. The activity generation plate further includes several ridge portions thereon to move the other driving rod up and down when the activity generation plate rotates.

4 Claims, 4 Drawing Sheets

MUSIC BOX

FIELD OF THE INVENTION

The present invention relates generally to a music box and in particular to the motivation mechanism thereof.

BACKGROUND OF THE INVENTION

Decorative toys, such as music boxes with beautiful surface pattern and configuration, are always favorite collections of article collectors. Some of the music boxes play music of a specific tone when opened. The other may have figures, such as dolls, on a platform to play a show when music is on. Different mechanisms have been adopted to motivate the figure to play the show. Most of those prior art motivation devices are very simple and generating no sophisticated motion of the figures.

A different motivation mechanism is provided by the present invention to move the dolls on the platform in a way different from the conventional music boxes to provide a more sophisticated motion pattern of the playing dolls of the music box.

OBJECTS OF THE INVENTION

A primary object of the present invention is to provide a music box which has a figure motivation mechanism different from the prior art and thus can provide a more sophisticated motion pattern to the figures of the music box.

Another object of the present invention is to provide a music box having a platform on which two figures are movably and/or rotatably mounted to move in different ways with the music played by the music box.

To achieve the above-mentioned objects, there is provided a music box comprising a hollow base within which a power supply and a driving mechanism are installed. A platform is rotatably mounted on the base to be driven by the driving mechanism on which a music playing doll and a dancing doll are movably and rotatably mounted. Each of the dolls has a driving rod secured thereon and the driving rods are guided by an activity generation plate which is disposed under the platform and driven by the driving mechanism to move and rotate the dolls. The activity generation plate has a circumferential groove in a wavy form in a plane parallel with the activity generation plate to receive therein an offset extension of one of the driving rods so as to move the extension portion in a radial direction and thus rotate the driving rod forth and back as the activity generation plate rotates. The activity generation plate further comprises several ridge portions thereon to move the other driving rod up and down when the activity generation plate rotates.

Other objects and advantages of the invention will be apparent from the following description of a preferred embodiment taken in connection with the accompanying drawings wherein:

DETAILED DESCRIPTION OF THE PREFERRED EMBODIMENT

Figure 1:
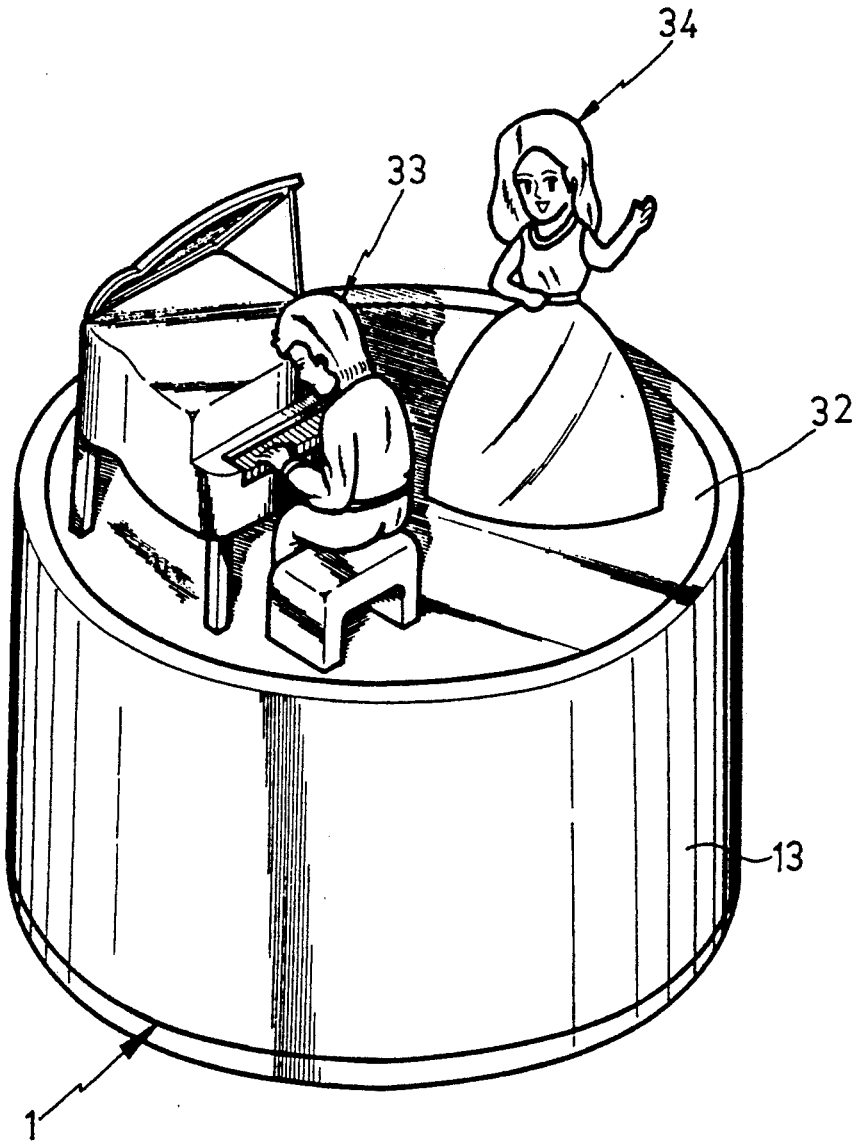
FIG. 1 is a perspective view showing a music box in accordance with the present invention.
Figure 2:
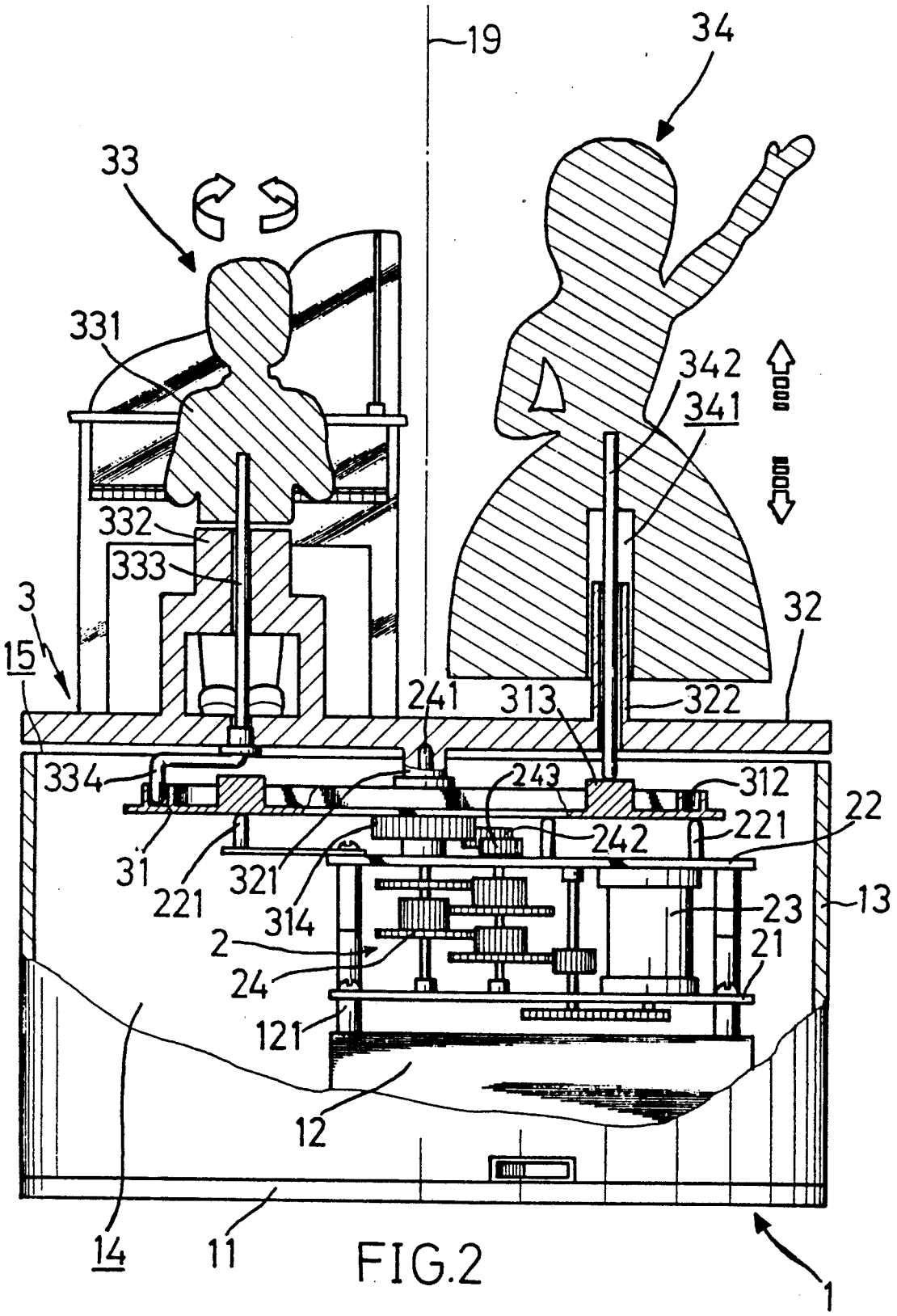
FIG. 2 is a side elevational view of the music box shown in FIG. 1, with a portion thereof broken to show the driving mechanism thereof.

With reference to the drawings and in particular to FIGS. 1 and 2, wherein a music box in accordance with the present invention is shown, the music box comprises a base 1 defined by a bottom plate 11 and a circumferential side wall 13, preferably a cylindrical one with a central axis 19, to form therein an open interior space 14 for receiving therein a power transmission system 2 and an activity generation system 3. A platform 32 in the form of a plate substantially complementary to the opening 15 of the base 1 is rotatably mounted to cover the opening 15.

A power chamber (battery chamber) 12 is disposed on the bottom plate 11 within the interior space 14. A plurality of bracings 121 are secured on the power chamber 12 to support a reduction gear train 24 with several support plates 21 and 22 which are secured on the bracings 121. A motor 23 which receives power from the power chamber 12 is also supported by the support plates 21 and 22 to drive the reduction gear train 24. As those skilled in the art of mechanical engineering know, the reduction gear train 24 may be comprised of several mating gears to reduce the rotational speed generated by the motor 23 to a desired angular speed and direction. This is a well known technique and thus no detail will be given.

An activity generation plate 31 (see FIGS. 3 and 4), preferably in the form of a disk, having a first surface 315 and a second surface 316 opposite to each other with a gear 314 concentrically mounted on the first surface 315, is interposed between the platform plate 32 and the bracings 121. The activity generation plate 31 is so disposed that the first surface 315 rotatably and movably rests on and thus is supported by a plurality of projections 221 secured on the bracings 121 and/or the support plates 22. Thus the activity generation plate 31 is rotatable and planar movable with respect to the projections 221 and thus the bracings 121. A central through hole 311 is formed on the activity generation plate 31 and extending through both the activity generation plate 31 and the gear 314.

Figure 3:
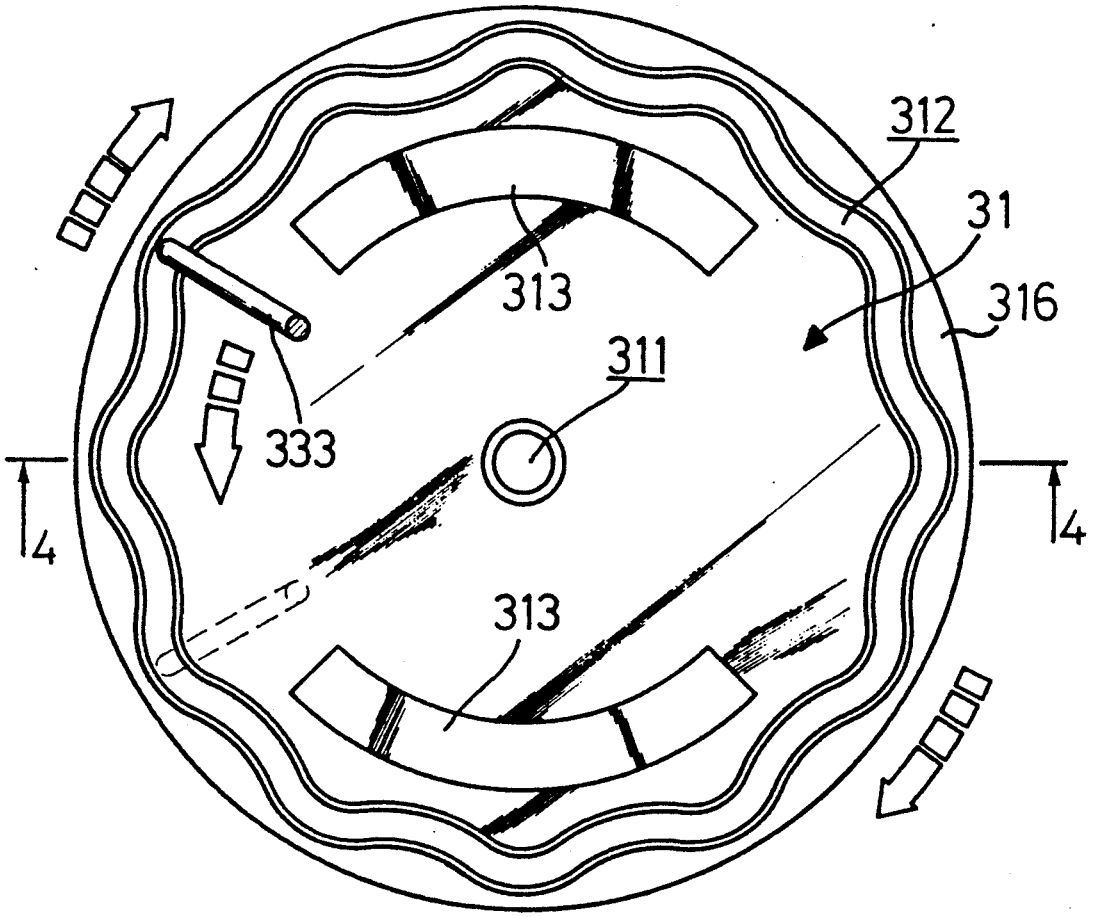
FIG. 3 is a top plan view showing the activity generation plate of the music box shown in FIG. 1.
Figure 4:
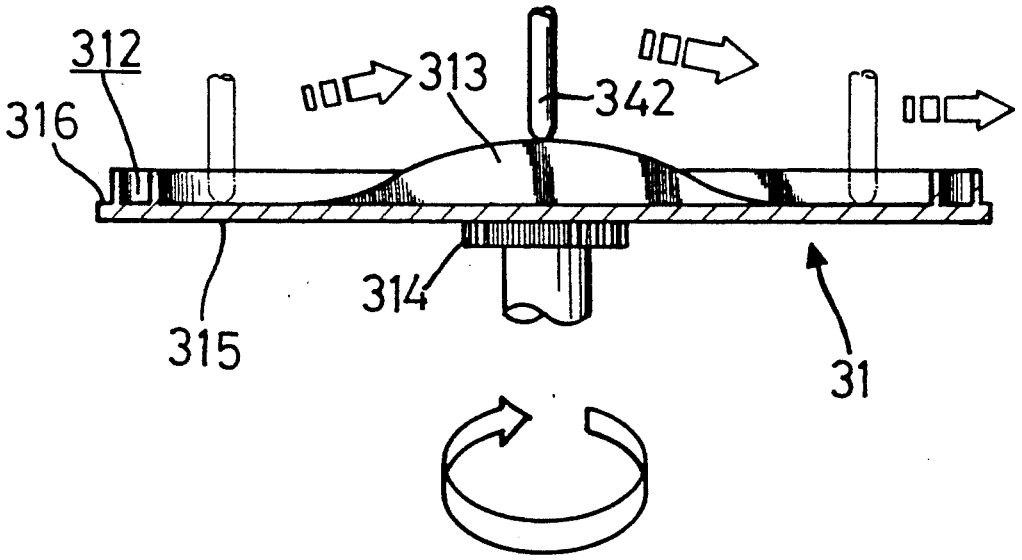
FIG. 4 is a cross-sectional view taken along line 4—4 of FIG. 3.

The activity generation plate 31 has a first doll guiding means, comprising a groove 312 formed on the second surface 316 thereof to receive therein an extension portion 334 of a first driving rod 333 for a first doll 331. The groove 312 is in a wavy form in a plane parallel to the second surface 316 of the activity generation plate 31, as shown in FIG. 3, so that when the activity generation plate 31 rotates, the first driving rod 333 is guided by the wavy groove 312 to successively move toward and away from the central hole 311. The extension 334 is offset from but substantially parallel with the first driving rod 333 so that when the extension 334 is guided to move in a radial direction as the activity generation plate 31 rotates, the first driving rod 333 is rotated back and forth. The back-and-forth rotation of the first driving rod 333 is limited within a given angle range determined by the wavy configuration of the groove 312.

Figure 5:
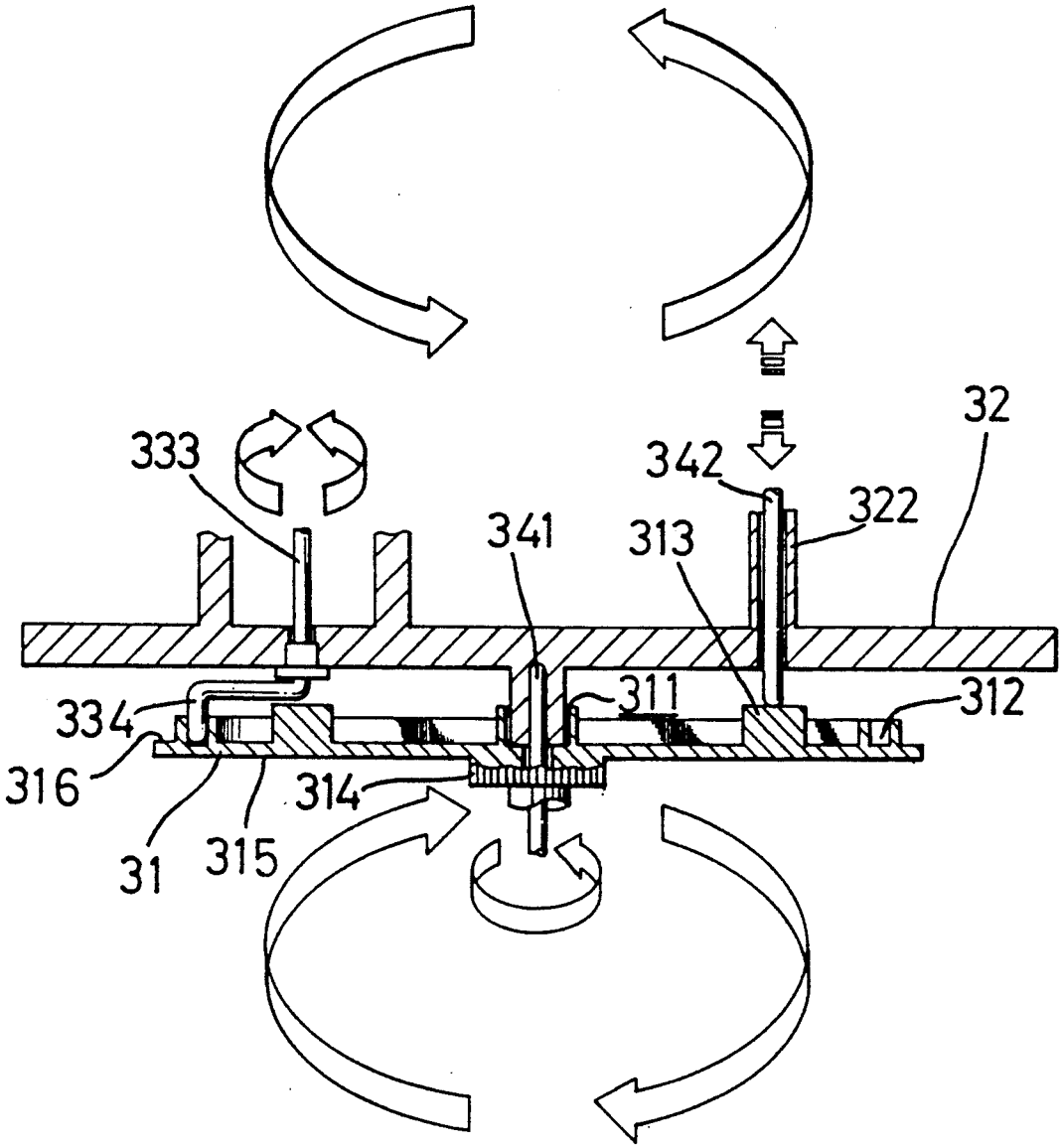
FIG. 5 is a cross-sectional view of a portion of the music box shown in FIG. 1 illustrating the driving of the playing dolls of the music box.

The activity generation plate 31 further has a second doll guiding means formed on the second surface 316 thereof, comprising a plurality of ridge portions 313 (see FIG. 4) defined on a trace of a second driving rod 342 for a second doll 34 so that when the activity generation plate 31 is rotated, the second driving rod 342 is guided by the ridge portions 313 to successively move up and down in a direction normal to the platform plate 32. The movements of the driving rods 333 and 342 are best shown in FIG. 5.

The reduction gear train 24 has a first output spindle 241 extending through the central through hole 311 of the activity generation plate 31 to be rotatable with respect to the activity generation plate 31 and then securely connected to the platform plate 32 at the center thereof and a second output pinion 243 which connects to the gear 314 of the activity generation plate 31 to drive the activity generation plate 31 with respect to the platform plate 32. Preferably, an idle pinion 242 is provided between the gear 314 fixed on the activity generation plate 31 and the second output pinion 243 in order to rotate the activity generation plate 31 in a direction opposite to the platform plate 32.

The first doll 33, as shown in the drawings, is a piano play figure, having a lower portion 332 fixed on the platform 32 and an upper portion 331 which is relatively movable to the lower portion 332. The first driving rod 333 rotatably penetrating through the platform 32 and the lower portion 332 of the first doll 33 is securely fixed in the upper portion 331 so that when the platform plate 32 and the activity generation plate 31 rotate, the radial movement of the extension 334 of the first driving rod 333 rotate the upper portion 331 with respect to the lower portion 332.

The second doll 34, as shown in the drawings, particularly FIG. 2, is a dancing figure secured on the second driving rod 342 which rotatably extends through the platform plate 32 to move up and down when the second driving rod 342 move on the ridges 313 of the activity generation plate 31. To further guide the second doll 34 moving in an up-and-down direction, a tubular member 322 is formed on the platform plate 32 and partially extends into a recess 341 formed on the second doll 34 in such a way to allow the second doll to be rotatable with respect thereto and to resists movement in a direction normal to the central axis of the tubular member 322. The second driving rod 342 rotatably extends through the tubular member 322 to be secured on the second doll 34 so as to be able to drive the second doll 34.

It is apparent that although the invention has been described in connection with a preferred embodiment, those skilled in the art may make changes to certain features of the preferred embodiment without departing from the spirit and scope of the invention as defined in the appended claims.

What is claimed is:

1. A music box comprising:

a base comprising a bottom plate and a circumferential side wall to define an open interior space;

a power source mounted within said interior space to activate a motor;

a power transmission system comprising a reduction gear train which is driven by said motor and has a first output and a second output;

a platform substantially covering the opening of said interior space with a plurality of dolls respectively mounted thereon by a first driving rod or a second driving rod, said first driving rod having an offset extension portion, said platform being rotatable with respect to said base by the first output of said power transmission system, said dolls being movable and/or rotatable with respect to said platform; and an activity generation plate rotatably disposed under said platform and driven by the second output of said reduction gear train, said activity generation plate comprising a circumferential groove formed on a second surface thereof to receive therein the offset extension portion of at least said first driving rod, said groove being in a wavy form in a plane parallel with said activity generation plate so that when said activity generation plate is rotated by the second output of said power transmission system, said offset extension is guided to move along a radial direction of said activity generation plate to rotate said first driving rod back and forth within a given angle range so as to rotate the doll secured thereon in a rotational forth-and-back style, said activity generation plate further comprising a plurality of ridge portions formed on the second surface thereof on which at least a second driving rod is movable as said activity generation plate is rotated so as to move said second driving rod and thus the doll secured thereon in an up-and-down style.

2. A music box as claimed in claim 1 wherein said plurality of dolls comprise a first doll having a lower portion fixed on said platform with said first driving rod rotatably extending therethrough and an upper portion secured on said first driving rod to be rotatable with respective to said lower portion by said first driving rod.

3. A music box as claimed in claim 1 wherein said plurality of dolls comprise a second doll secured on said second driving rod to be movable along a direction substantially normal to said platform by said second driving rod.

4. A music box as claimed in claim 3 wherein said second doll has a recess to receive therein a portion of a tubular member which is mounted on said platform in such a way to allow said second doll to be movable along and rotatable about an axis thereof without movement in a direction normal to the axis, said second driving rod rotatably extending through said tubular member and into said recess to be secured on said second doll.

* * * * *